US010213077B2

(12) United States Patent
Genn et al.

(10) Patent No.: US 10,213,077 B2
(45) **Date of Patent: *Feb. 26, 2019**

(54) CLEANER HEAD

(71) Applicant: Dyson Technology Limited, Wiltshire (GB)

(72) Inventors: Stuart Lloyd Genn, Swindon (GB); James White, Swindon (GB)

(73) Assignee: DYSON TECHNOLOGY LIMITED, Malmesbury, Wiltshire (GB)

( * ) Notice: Subject to any disclaimer, the term of this patent is extended or adjusted under 35 U.S.C. 154(b) by 354 days.

This patent is subject to a terminal disclaimer.

(21) Appl. No.: 14/662,923

(22) Filed: Mar. 19, 2015

(65) Prior Publication Data

US 2015/0265117 A1 Sep. 24, 2015

(30) Foreign Application Priority Data

Mar. 19, 2014 (GB) ..... 1404918.3

(51) Int. Cl.
*A47L 9/04* (2006.01)

(52) U.S. Cl.
CPC ..... *A47L 9/0411* (2013.01); *A47L 9/0455* (2013.01); *A47L 9/0477* (2013.01)

(58) Field of Classification Search
None
See application file for complete search history.

(56) References Cited

U.S. PATENT DOCUMENTS 1,613,396 A 1/1927 Keller
1,770,643 A 7/1930 Giambertoni
1,914,834 A 6/1933 Otto
1,953,340 A 4/1934 Doemling
3,172,138 A 3/1965 Price
4,268,769 A 5/1981 Dorner et al.
4,384,386 A 5/1983 Dorner et al.
4,538,322 A 9/1985 Ahlf et al.
4,660,247 A * 4/1987 Frohbieter ..... A47L 9/0411 15/339

(Continued)

FOREIGN PATENT DOCUMENTS

DE 529616 7/1931
DE 1 728 324 10/1971

(Continued)

OTHER PUBLICATIONS

International Search Report and Written Opinion dated May 12, 2015, directed to International Application No. PCT/GB2015/050664; 11 pages.

(Continued)

*Primary Examiner* — Joseph J Hail
*Assistant Examiner* — Brian D Keller
(74) *Attorney, Agent, or Firm* — Morrison & Foerster LLP

(57) ABSTRACT

A cleaner head that includes a main body having an agitator chamber, an axle that extends into the chamber, a bearing assembly mounted on the axle, a biasing member, and an agitator mounted on the bearing assembly. The bearing assembly is moveable along the axle between a first position and a second position. The biasing member then biases the bearing assembly towards the first position, and the agitator pushes the bearing assembly against the biasing member towards the second position.

19 Claims, 5 Drawing Sheets

(56) References Cited

U.S. PATENT DOCUMENTS

| | | | | |
|---|---|---|---|---|
| 4,777,691 | A | 10/1988 | Richmond et al. | |
| 6,134,745 | A | 10/2000 | Wörwag | |
| 6,320,292 | B1 | 11/2001 | Tateishi et al. | |
| 6,323,570 | B1 | 11/2001 | Nishimura | |
| 8,572,804 | B2 * | 11/2013 | Tran | A47L 9/045 15/332 |
| 2002/0032948 | A1 | 3/2002 | Ahn et al. | |
| 2002/0060140 | A1 | 5/2002 | Nakamura et al. | |
| 2002/0079761 | A1 | 6/2002 | Nishimura et al. | |
| 2002/0184732 | A1 | 12/2002 | Kim et al. | |
| 2002/0194697 | A1 | 12/2002 | Park | |
| 2003/0037408 | A1 | 2/2003 | Park | |
| 2003/0159240 | A1 | 8/2003 | Mertes et al. | |
| 2003/0188397 | A1 | 10/2003 | Syverson et al. | |
| 2004/0000023 | A1 | 1/2004 | Hitzelberger et al. | |
| 2004/0010884 | A1 | 1/2004 | Hitzelberger | |
| 2004/0025287 | A1 | 2/2004 | McCormick et al. | |
| 2005/0160555 | A1 | 7/2005 | Mayes | |
| 2005/0160556 | A1 | 7/2005 | Hitzelberger et al. | |
| 2005/0172447 | A1 | 8/2005 | Roney et al. | |
| 2006/0064828 | A1 * | 3/2006 | Stein | A47L 9/0455 15/41.1 |
| 2009/0089958 | A1 | 4/2009 | Dant et al. | |
| 2010/0037422 | A1 | 2/2010 | Behrenswerth et al. | |
| 2010/0107357 | A1 | 5/2010 | Odachi et al. | |
| 2011/0303239 | A1 | 12/2011 | Harrison et al. | |
| 2015/0265116 | A1 | 9/2015 | Genn et al. | |

FOREIGN PATENT DOCUMENTS

| | | |
|---|---|---|
| DE | 197 06 239 | 4/1998 |
| DE | 198 05 899 | 7/1999 |
| DE | 198 05 900 | 7/1999 |
| DE | 198 05 901 | 8/1999 |
| DE | 20 2011 104 043 | 11/2011 |
| GB | 2 224 042 | 4/1990 |
| GB | 2 322 068 | 8/1998 |
| GB | 2 376 177 | 12/2002 |
| GB | 2 376 876 | 12/2002 |
| GB | 2499213 | 8/2013 |
| JP | 54-118659 | 9/1979 |
| JP | 63-102740 | 5/1988 |
| JP | 63-102741 | 5/1988 |
| JP | 63-125227 | 5/1988 |
| JP | 63-132624 | 6/1988 |
| JP | 63-154143 | 6/1988 |
| JP | 63-154144 | 6/1988 |
| JP | 63-158030 | 7/1988 |
| JP | 63-158031 | 7/1988 |
| JP | 63-229017 | 9/1988 |
| JP | 63-296719 | 12/1988 |
| JP | 64-25824 | 1/1989 |
| JP | 1-166730 | 6/1989 |
| JP | 1-99347 | 7/1989 |
| JP | 1-265930 | 10/1989 |
| JP | 2-95675 | 4/1990 |
| JP | 2-209113 | 8/1990 |
| JP | 7-313411 | 12/1995 |
| JP | 7-327880 | 12/1995 |
| JP | 7-327882 | 12/1995 |
| JP | 7-327884 | 12/1995 |
| JP | 8-38400 | 2/1996 |
| JP | 11-42184 | 2/1999 |
| JP | 2000-217754 | 8/2000 |
| JP | 2000-245661 | 9/2000 |
| JP | 2000-245662 | 9/2000 |
| JP | 2000-245663 | 9/2000 |
| JP | 2000-254052 | 9/2000 |
| JP | 2000-254053 | 9/2000 |
| JP | 2000-296082 | 10/2000 |
| JP | 2000-308607 | 11/2000 |
| JP | 2000-308608 | 11/2000 |
| JP | 2000-316762 | 11/2000 |
| JP | 2000-316763 | 11/2000 |
| JP | 2000-316764 | 11/2000 |
| JP | 2000-333891 | 12/2000 |
| JP | 2000-354569 | 12/2000 |
| JP | 2001-371 | 1/2001 |
| JP | 2001-8405 | 1/2001 |
| JP | 2001-157657 | 6/2001 |
| JP | 2001-204657 | 7/2001 |
| JP | 2001-231727 | 8/2001 |
| JP | 2001-238831 | 9/2001 |
| JP | 2001-245831 | 9/2001 |
| JP | 2001-346729 | 12/2001 |
| JP | 2001-346730 | 12/2001 |
| JP | 2002-238815 | 8/2002 |
| JP | 2002-272654 | 9/2002 |
| JP | 2002-315700 | 10/2002 |
| JP | 2004-57446 | 2/2004 |
| JP | 2005-312589 | 11/2005 |
| JP | 2009-247723 | 10/2009 |
| WO | WO-2008/128751 | 10/2008 |

OTHER PUBLICATIONS

Search Report dated Sep. 18, 2014, directed to GB Application No. 1404918.3; 1 pg.

Genn et al., U.S. Office Action dated Mar. 20, 2017 directed to U.S. Appl. No. 14/662,745; 11 pages.

Genn et al., U.S. Office Action dated Dec. 4, 2017, directed to U.S. Appl. No. 14/662,745; 17 pages.

Genn et al., U.S. Office Action dated Aug. 1, 2018, directed to U.S. Appl. No. 14/662,745; 18 pages.

* cited by examiner

CLEANER HEAD

REFERENCE TO RELATED APPLICATION

This application claims priority to United Kingdom Application No. 1404918.3, filed Mar. 19, 2014, the entire contents of which are incorporated herein by reference.

FIELD OF THE INVENTION

The present invention relates to a cleaner head for an appliance such as a vacuum cleaner.

BACKGROUND OF THE INVENTION

The cleaner head of an appliance, such as a vacuum cleaner, may include an agitator rotatably mounted within a main body. Tolerances in the cleaner head may mean that there is a degree of play in the agitator relative to the main body. Consequently, as the agitator rotates, the agitator vibrates and generates noise.

SUMMARY OF THE INVENTION

The present invention provides a cleaner head comprising a main body having an agitator chamber, an axle that extends into the chamber, a bearing assembly mounted on the axle, the bearing assembly being moveable along the axle between a first position and a second position, a biasing member biasing the bearing assembly towards the first position, and an agitator rotatably mounted within the chamber, wherein the agitator is mounted on the bearing assembly and pushes the bearing assembly along the axle against the biasing member towards the second position.

Since the agitator pushes against the biasing member, any play of the agitator in an axial direction (i.e. in a direction parallel to the rotational axis of the agitator) is prevented or reduced.

The bearing assembly may comprise a mount having a ramped surface, and the agitator may have a ramped surface at one end. The agitator is then supported on the mount such that the ramped surface of the agitator mates with the ramped surface of the mount. As a result, play of the agitator in a radial direction (i.e. in a direction normal to the rotational axis of the agitator) is prevented or reduced. Additionally, the ramped surfaces help improve the concentricity of the agitator relative to the bearing assembly. As a result, radial loading of the bearing assembly by the agitator is reduced and therefore the lifespan of the bearing assembly, and thus the cleaner head, is prolonged.

The bearing assembly may comprise a bearing secured to a carriage, and the carriage may be prevented from rotating relative to the axle when the bearing assembly is in the second position. Consequently, as the agitator rotates, rotation of the inner race of the bearing relative to the axle is prevented and thus wear of the axle is avoided. For example, the axle may have a non-circular cross-section, or the carriage may have projections that engage with grooves in the axle. Alternatively, the carriage and the cleaner head may comprise components that engage when the bearing assembly is in the second position so as to prevent rotation of the carriage relative to the axle, and the components may disengage when the bearing assembly is in the first position. For example, the cleaner head may comprise a sprocket that surrounds the axle, and the carriage may comprise teeth that engage with the sprocket when the bearing assembly is in the second position and disengage with the sprocket when the bearing assembly in the first position. This then permits the use of a circular axle and carriage, which results in a more compact arrangement.

The main body may comprise an opening through which the agitator is removable. The cleaner head may then comprise an end cap that is attachable to the main body to close the opening. Moreover, the agitator may be mounted at a first end on the bearing assembly and at a second end on a bearing or bushing seated within the end cap. A removable agitator has the advantage that the agitator may be more easily cleaned or repaired. With a conventional cleaner head having a removable agitator, there is often a large degree of play in the movement of the agitator relative to the main body. With the cleaner head of the present invention, play in the agitator is prevented or reduced by the biasing member. Upon releasing or removing the end cap from the main body, the biasing member provides a force that pushes the agitator out of the opening. As a result, a user is able to more easily grasp the agitator in order to pull it from the main body.

The cleaner head may comprise a drive assembly for driving the agitator. The drive assembly may then be mounted on the axle, and the agitator may surround the drive assembly. As a result, a more compact cleaner head may be realised. Furthermore, the drive assembly may transfer torque to the agitator without the need for a complex transmission arrangement. Should the agitator be removable from the main body, the agitator may slide over the drive assembly like a sleeve. A coupling element formed integrally within the agitator may then engage directly with the drive assembly. As a result, removal of the agitator from the main body is made relatively easy.

The bearing assembly may contact the drive assembly when in the first position. This then has the advantage that, when the agitator is removed, the drive assembly acts as a stop for the bearing assembly.

The cleaner head may be attached to a duct for rotation about an axis, and the drive assembly may be mounted on the axle such that the centre of gravity of the cleaner head is located in a vertical plane containing the axis. When a conventional cleaner head is lifted off the floor, the head will typically rotate to the left or right due to the weight of the drive assembly. Positioning the drive assembly such that the centre of gravity of the cleaner head is in a vertical plane containing the rotational axis has the advantage that, when lifted, the cleaner head remains level. This then makes handling of the cleaner head easier. Reference is made to a vertical plane since it is not essential that the centre of gravity of the cleaner head lies directly on the rotational axis. Rotation of the cleaner head relative to the duct will also be prevented by having a centre of gravity that is located directly above or below the rotational axis. In the present context, the term 'containing' should be understood to mean that the rotational axis is contained wholly within the vertical plane (i.e. the rotational axis is parallel to the vertical plane) and not simply that the rotational axis passes through the vertical plane.

The biasing member may comprise a coil spring that surrounds the axle. This then has the advantage of providing a relatively compact arrangement for biasing the bearing assembly.

BRIEF DESCRIPTION OF THE DRAWINGS

In order that the present invention may be more readily understood, an embodiment of the invention will now be described, by way of example, with reference to the accompanying drawings in which.

DETAILED DESCRIPTION OF THE INVENTION

Figure 1:
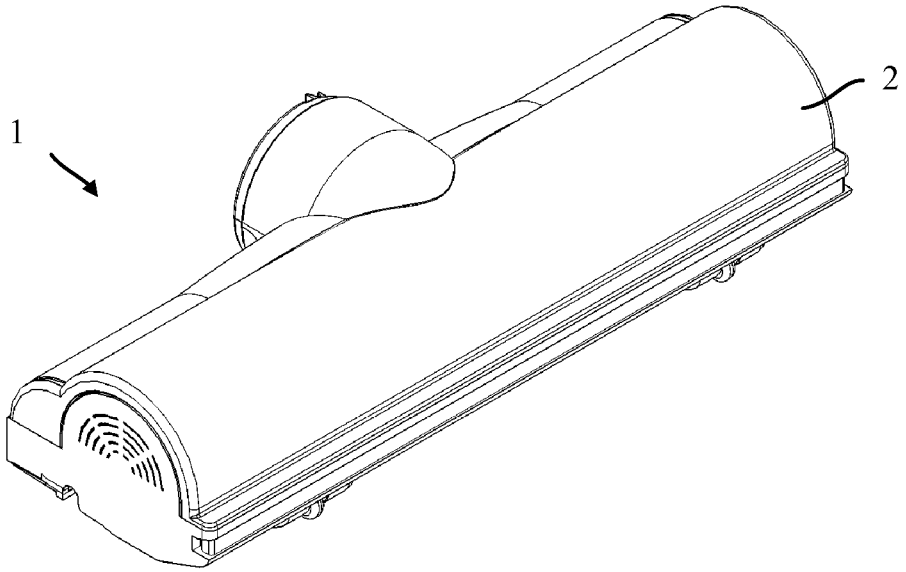
FIG. 1 illustrates a cleaner head in accordance with the present invention.
Figure 2:
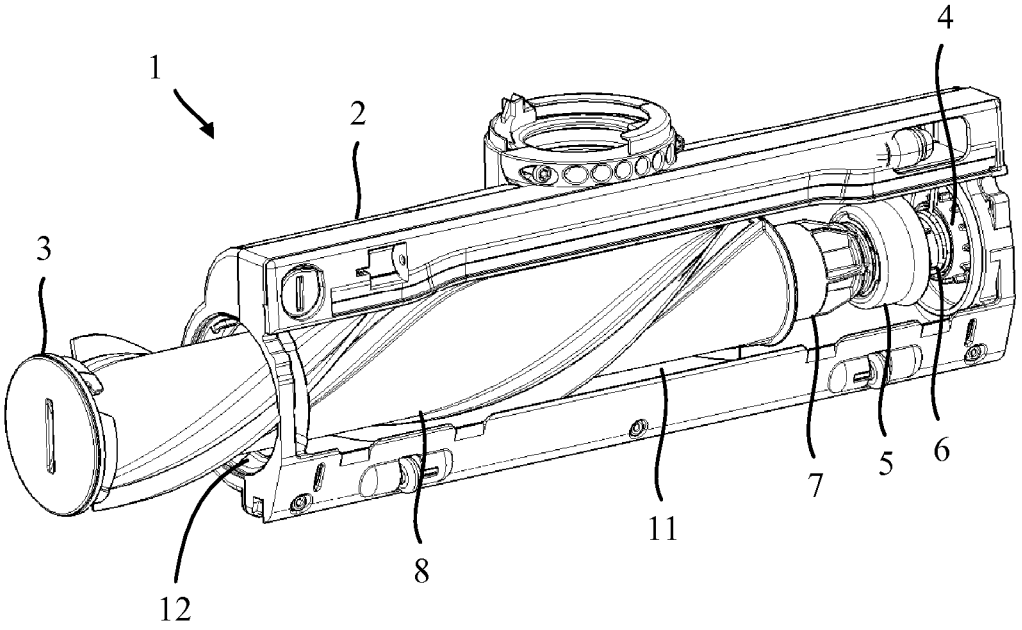
FIG. 2 illustrates the underside of the cleaner head with the agitator partially removed.
Figure 3:
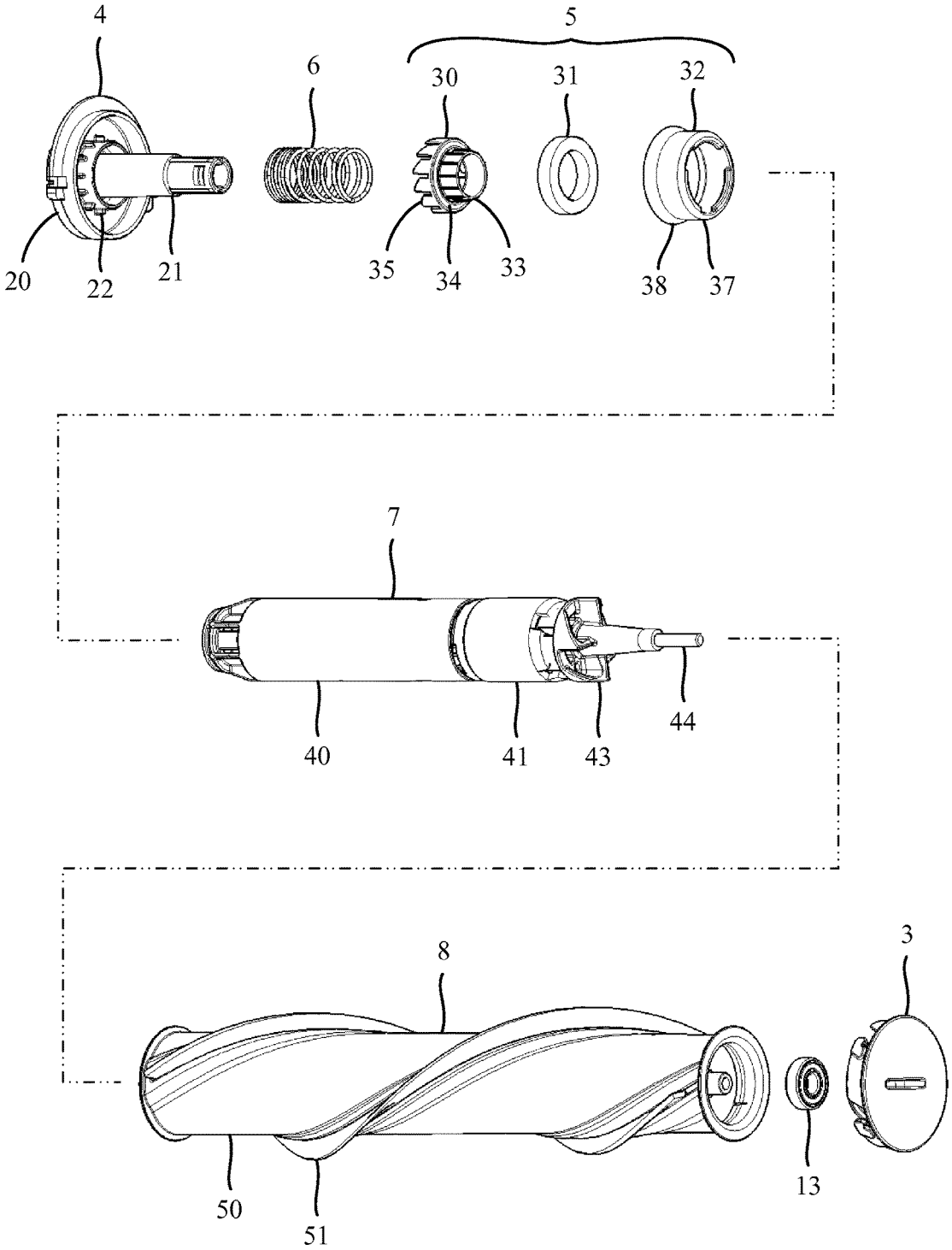
FIG. 3 is an exploded view of the end caps, the bearing assembly, the drive assembly and the agitator of the cleaner head.
Figure 4:
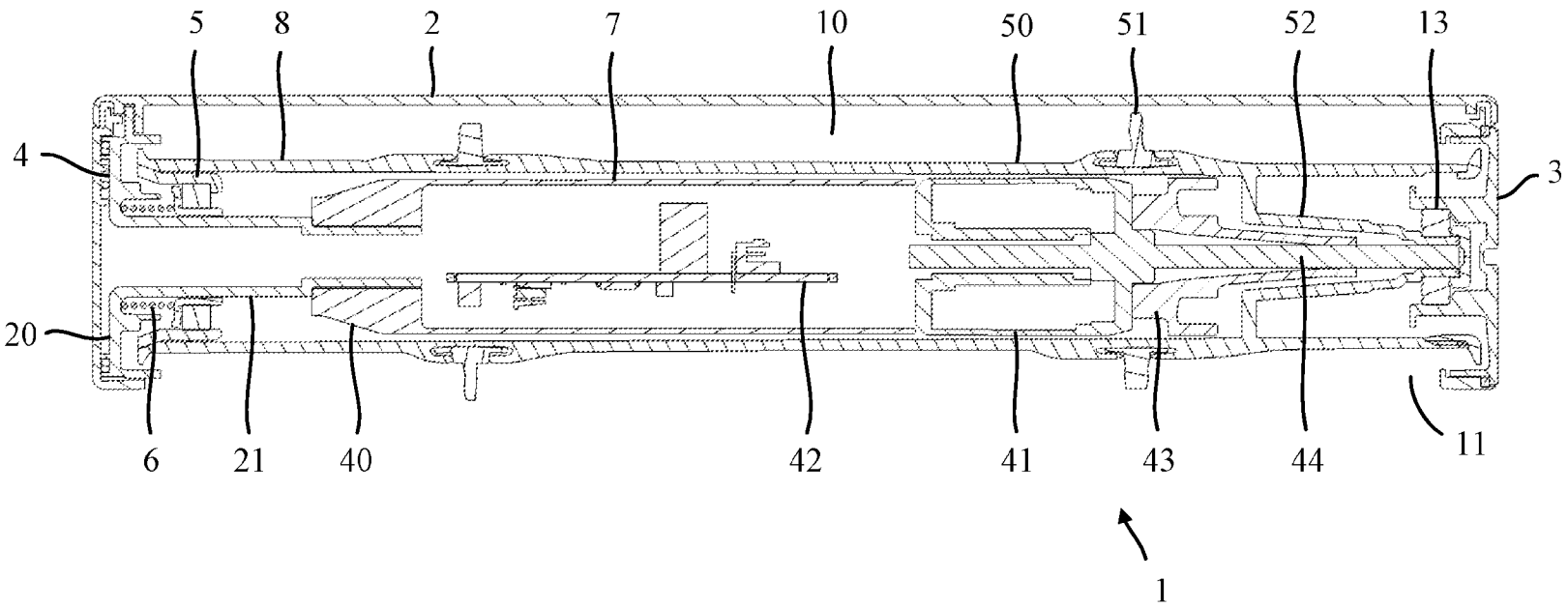
FIG. 4 is a sectional slice through the centre of the cleaner head.
Figure 5:
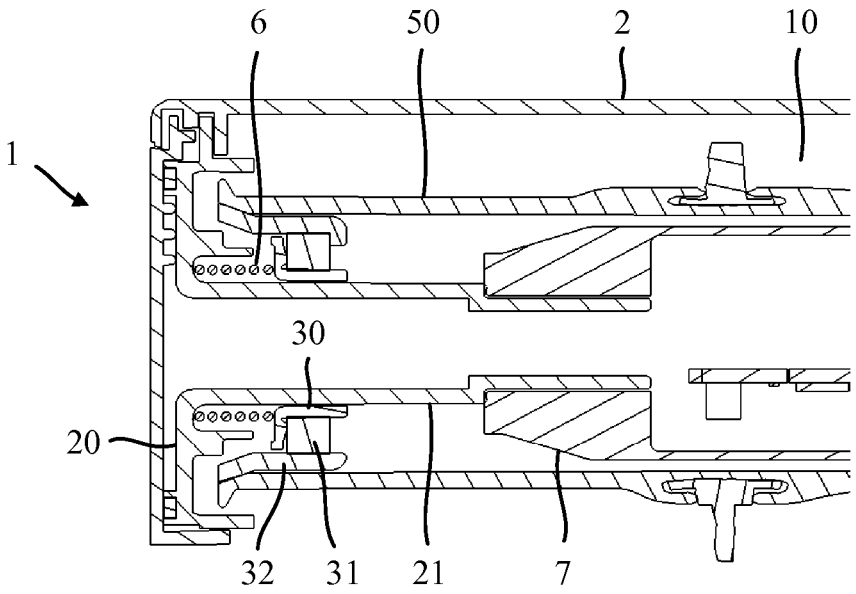
FIG. 5 is a portion of the sectional slice of FIG. 4 in which the agitator is mounted within the main body of the cleaner head and the bearing assembly is in a second position.
Figure 6:
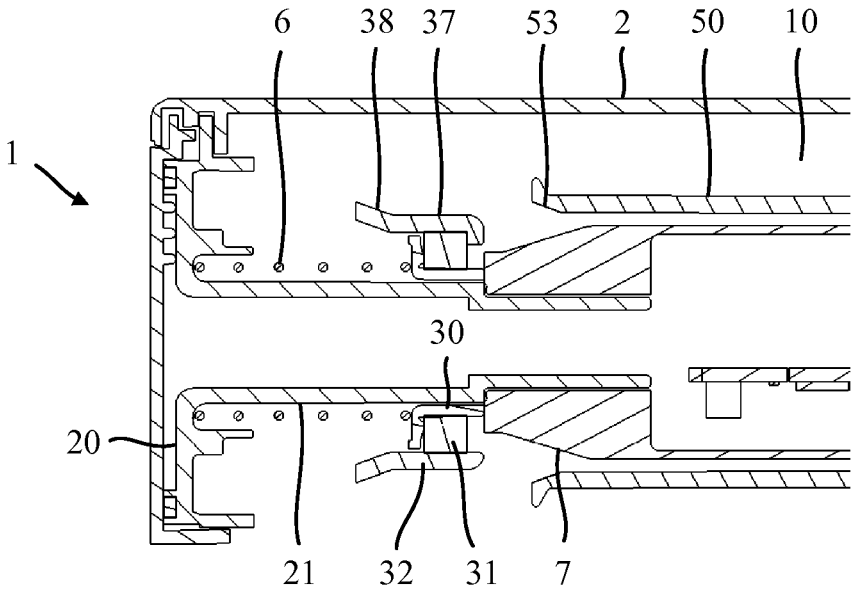
FIG. 6 illustrates the same view as that of FIG. 5 but the agitator is now partly removed from the main body of the cleaner head and the bearing assembly is in a first position.

The cleaner head 1 of FIGS. 1 to 6 comprises a main body 2, a first end cap 3, a second end cap 4, a bearing assembly 5, a biasing member 6, a drive assembly 7 and an agitator 8.

The main body 2 comprises an agitator chamber 10 within which the agitator 8 is rotatable mounted. An opening 11 is provided in the base of the main body 2, through which the agitator 8 is able to agitate a surface. A further opening 12 is provided in a side of the main body 2, through which the agitator 8 is removable from the main body 2.

The two end caps 3,4 are secured to the main body 2 at opposite sides of the agitator chamber 10. The first end cap 3 is secured to the main body 2 so as to close the side opening 12. The end cap 3 is secured by means of a bayonet-style fitting and comprises a number of L-shaped slots that engage with an equal number of projections formed on the main body 2. The second end cap 4 comprises a disc 20, an axle 21 that extends centrally from the disc 20, and a sprocket 22 that surrounds the axle 21. The end cap 4 is secured to the main body 2 such that the axle 21 extends into the agitator chamber 10.

The bearing assembly 5 is slidably mounted on the axle 21. Movement of the bearing assembly 5 along the axle 21 is limited in one direction by the drive assembly 7, which is mounted to the axle 21, and in an opposite direction by the disc 20. Consequently, the bearing assembly 5 is moveable between a first position in which the bearing assembly 5 contacts the drive assembly 7 (see FIG. 6) and a second position in which the bearing assembly 5 contacts the disc 20 (see FIG. 5).

The bearing assembly 5 comprises a carriage 30, a bearing 31 secured to the carriage 30, and a mount 32 secured to the bearing 31. The carriage 30 may be regarded as having a first portion and a second portion. The first portion comprises a collar 33 that surrounds the axle 21. The second portion comprises a brim 34 that extends radially from the collar 33 and a plurality of teeth or pickets 35 that extend axially from the brim 34 in a direction towards the disc 20 of the second end cap 4. The bearing 31 comprises an inner race and an outer race. The inner race is then secured to the carriage 30, and the outer race is secured to the mount 32. The mount 32 comprises a cylindrical section 37 and a conical section 38 that extends outwardly from an end of the cylindrical section 37.

The biasing member 6 comprises a coil spring that surrounds the axle 21. The biasing member 6 is located between the disc 20 of the second end cap 4 and the carriage 30 of the bearing assembly 5. The biasing member 6 thus biases the bearing assembly 5 towards the first position.

The drive assembly 7 is mounted on the axle 21 and comprises a motor mount 40, an electric motor 41, a circuit assembly 42 for controlling the electric motor 41, and a coupling element 43. The motor mount 40 comprises a generally cylindrical body that houses the circuit assembly 42. The motor mount 40 is secured at one end to the axle 21 and at an opposite end to the electric motor 41. The electric motor 41 is secured to the motor mount 40 such that the shaft 44 of the electric motor 41 is co-axial with the axle 21 and thus with the bearing assembly 5. The coupling element 43 is secured to the shaft 44 of the electric motor 41.

The agitator 8 comprises a cylindrical body 50 to which bristles, flicker strips, or other means 51 for agitating a surface are secured. The agitator 8 further comprises a coupling element 52 located inside and formed integrally with the body 50. The agitator 8 is mounted at one end on the bearing assembly 5, and at the opposite end on a bearing 13 seated within the first end cap 3. The agitator 8 is thus rotatably mounted within the agitator chamber 10. The agitator 8 pushes the bearing assembly 5 along the axle 21 against the biasing member 6 towards the second position. The teeth 35 of the carriage 30 then engage with the sprocket 22. The agitator 8 surrounds the drive assembly 7, and the coupling element 43 of the drive assembly 7 engages with the coupling element 52 of the agitator 8 such that the torque generated by the electric motor 41 is transferred to the agitator 8.

During operation, the torque generated by the drive assembly 7 is transferred to the agitator 8, thereby causing the agitator 8 to rotate. The biasing member 6 biases the bearing assembly 5 towards the first position, i.e. in a direction towards the first end cap 3. The agitator 8, which is mounted between the bearing assembly 5 and the first end cap 3, is therefore held relatively tightly within the agitator chamber 10. Consequently, movement of the agitator 8 in an axial direction (i.e. in a direction parallel to the rotational axis of the agitator 8) is significantly reduced. Indeed, axial movement is possible only by overcoming the bias force of the biasing member 6, which is already in a compressed or charged state.

An end of the agitator 8 comprises a conical inner surface 53 which mates with the conical section 38 of the mount 32. Since the biasing member 6 biases the bearing assembly 5 in a direction towards the first end cap 3, the conical section 38 of the mount 32 is pushed into and mates tightly with the conical surface 53 of the agitator 8. This then has two benefits. First, the agitator 8 is held tightly at one end against the mount 32. The opposite end of the agitator is held tightly against the bearing 13 seated within the first end cap 3. Consequently, movement of the agitator 8 in a radial direction (i.e. in a direction normal to the rotational axis of the agitator 8) is prevented. Second, by employing conical surfaces, the concentricity of the agitator 8 relative to the bearing 31 is improved. Consequently, as the agitator 8 rotates, radial loading of the bearing 31 is reduced. In particular, radial loading due to out-of-balance forces are reduced and thus the lifespan of the bearing 31 is prolonged.

The outer diameter of the cylindrical section 37 of the mount 32 is slightly larger than that of the drive assembly 7.

Consequently, should the agitator 8 slip off or otherwise find itself unsupported by the conical section 38, the agitator 8 is nevertheless prevented from contacting the drive assembly 7.

The teeth 35 of the carriage 30 engage the sprocket 22 of the second end cap 4 such that rotation of the carriage 30 relative to the axle 21 is prevented. Consequently, as the agitator 8 rotates, the mount 32 and the outer race of the bearing 31 rotate, whilst the carriage 30 and inner race of the bearing 31 remain static. This then ensures that the carriage 30 does not rotate relative to the axle 21, which would otherwise generate significant noise and eventually lead to wear and potential failure of the carriage 30 and/or axle 21.

The agitator 8 is removable from the main body 2 in order that a user may more easily remove hair, fibre, and other debris that have become trapped around the agitator 8. In order to remove the agitator 8, the first end cap 3 is released from the main body 2 by twisting the first end cap 3 relative to the main body 2. The biasing member 6 biases the bearing assembly 5 and thus the agitator 8 in a direction towards the first end cap 3. Consequently, on releasing the first end cap 3, the biasing member 6 pushes the agitator 8 out of the side opening 12. The agitator 8 thus protrudes from the main body 2 allowing a user to grasp the agitator 8 and pull it through the side opening 12.

Once cleaned, the agitator 8 is returned to the main body 2 by inserting the agitator 8 through the side opening 12. As the agitator 8 is pushed through the side opening 12, the agitator 8 slides over the drive assembly 7 like a sleeve. The end of the agitator 8 then contacts the bearing assembly 5. More specifically, the conical inner surface 53 of the agitator 8 mates with the conical section 38 of the mount 32. As the agitator 8 is pushed further into the main body 2, the agitator 8 pushes the bearing assembly 5 against the biasing member 6 towards the second position. The coupling element 52 of the agitator 8 then engages with the coupling element 43 of the drive assembly 7, and the teeth 35 of the carriage 30 engage with sprocket 12 of the second end cap 3. Finally, the first end cap 3, which is carried by the agitator 8 by virtue of the bearing 13, is secured to the main body 2 so as to close the side opening 12.

Figure 7:
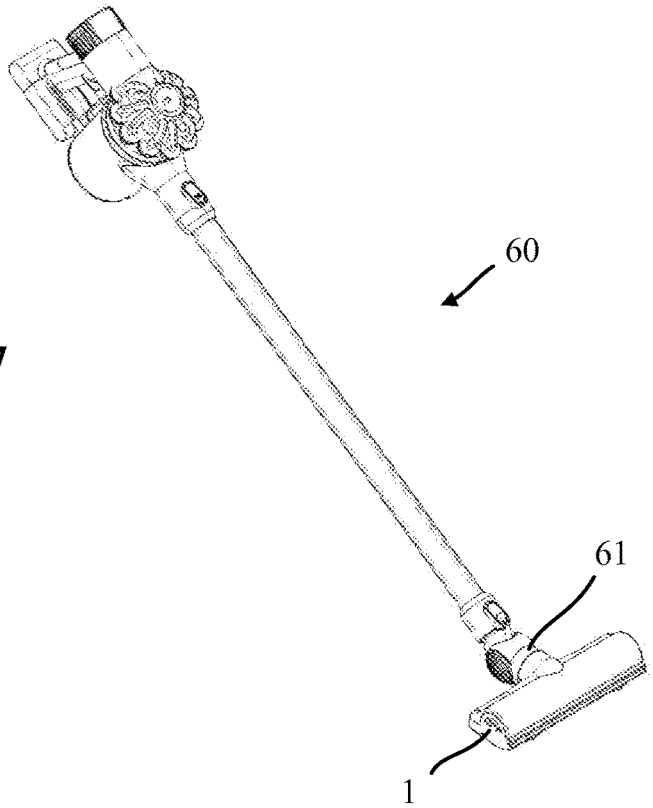
FIG. 7 illustrates a cleaning appliance in accordance with the present invention.
Figure 8:
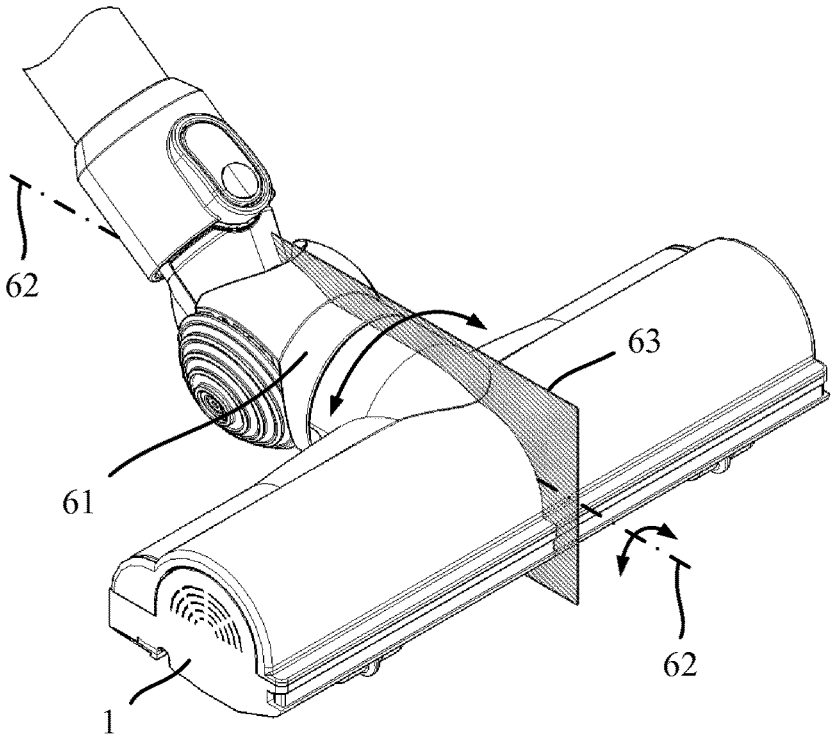
FIG. 8 illustrates part of the cleaning appliance in which the attachment of the cleaner head to a duct is shown, as is the axis of rotation about which the cleaner head rotates relative to the duct.

FIGS. 7 and 8 illustrate a cleaning appliance 60 comprising the cleaner head 1. In this particular example, the cleaning appliance 60 is a stick vacuum cleaner. However, the cleaner head 1 may equally be used with other types of cleaning appliance. The cleaner head 1 is rotatably attached to a duct 61 of the cleaning appliance 60. More particularly, the cleaner head 1 rotates relative to the duct 61 about a rotational axis 62. This rotational axis 62 is then orthogonal to the axis of rotation of the agitator 8. The two axes may be spaced from one another, which is to say that the two axes do not necessary intersect. Nevertheless, the two axes are orthogonal, i.e. the unit vectors are orthogonal.

The drive assembly 7 forms a relatively heavy component of the cleaner head 1 and thus has a large influence on the location of the centre of gravity of the cleaner head 1. The drive assembly 7 is mounted along the axle 21 such that the centre of gravity of the cleaner head 1 lies in a vertical plane 63 containing the rotational axis 62 of the cleaner head 1. This then has the advantage that, when the cleaner head 1 is lifted off the floor (e.g. in order to manoeuvre the cleaner head 1 over or around an object), the cleaner head 1 does not rotate relative to the duct 61. This then makes handling of the cleaner head 1 easier. In contrast, the centre of gravity of most conventional cleaner heads is offset relative to the axis of rotation. Consequently, when the cleaner head is lifted off the floor, the cleaner head rotates to one side, thus making handling more difficult.

A weight-balanced cleaner head 1 is made possible by having a motor mount 40 that spans the vertical plane 63 containing the rotational axis 62 of the cleaner head 1. Consequently, the electric motor 41, which represents a relatively heavy component of the drive assembly 7 and thus of the cleaner head 1, is mounted to the main body 2 on one side of the vertical plane 63 but is then physically located on the opposite side of the vertical plane 63. It is not at all obvious to locate the electric motor 41 in this manner, particular when the agitator 8 is removable, since the weight of the electric motor 41 generates a relatively large moment of force that acts on the axle 21. Moreover, if there is any radial play in the agitator 8, the weight of the electric motor 41 acting on the agitator 8 will cause the rotational axis of the agitator 8 to precess, thereby generating significant out-of balance forces.

The centre of gravity of the cleaner head 1 need not lie directly on the rotational axis 62 of the cleaner head 1. Rotation of the cleaner head 1 relative to the duct 61 will also be prevented by having a centre of gravity that is located directly above or below the rotational axis 62. It is for this reason that reference is made to a vertical plane 63 containing the rotational axis 62.

In the embodiment described above, the agitator 8 is removable from the main body 2. This then has the advantage that debris trapped around the agitator 8 may be more easily removed. Nevertheless, it is not essential that the agitator 8 is removable from the main body 2, and trapped debris may be removed by accessing the agitator 8 via the opening 11 in the base of the main body 2.

The drive assembly 7 comprises an electric motor 41, which generates the torque necessary to drive the agitator 8. Conceivably, the drive assembly 7 might comprise alternative means for generating the necessary torque. For example, where the cleaner head 1 is intended to form part of a vacuum cleaner, the drive assembly 7 may comprise an air turbine. The suction generated by the vacuum cleaner may then cause air to be drawn in through an opening in a side of the main body 2, through the centre of the axle 21, through the drive assembly 7 to thereby power the air turbine, and then out through an end of the agitator 8 and into the agitator chamber 10.

In the embodiment described above, the drive assembly 7 is located wholly within the agitator 8. This then has the advantage of providing a relatively compact cleaner head 1. Nevertheless, the drive assembly 7, or part thereof, may be located outside the agitator 8. For example, the electric motor 41 and the circuit assembly 42 may be located elsewhere in the main body 2, and torque may be transferred from the electric motor 41 to the agitator 8 via a transmission arrangement. Moreover, depending on the type of cleaning appliance, the drive assembly 7 could conceivably be located within the body of the cleaning appliance.

The mount 32 has been described as having a cylindrical section 37 and a conical section 38. The conical section 38 then mates with a conical surface 53 of the agitator 8, and the cylindrical section 37 provides a safeguard for supporting the agitator 8 should the agitator 8 slip from the conical section 38. In should nevertheless be appreciated that the mount 32 may have any shape capable of supporting the agitator 8. That being said, there are advantages in providing the mount 32 with a ramped surface that mates with a corresponding ramped surface in the agitator 8. In particular, movement of the agitator 8 in a radial direction may be prevented or significantly reduced. Additionally, relatively good concentricity may be achieved between the agitator 8 and the bearing 31. Consequently, radial loading of the bearing 31 by the agitator 8 is reduced and thus the lifespan of the bearing 31 is prolonged.

Remaining with the bearing assembly 7, it is not necessary that the carriage 30 of the bearing assembly 7 has teeth 35 or that the first end cap 3 has a sprocket 22. Indeed, it is not essential that the bearing assembly 7 comprises a carriage 30 at all. For example, the carriage 30 may be omitted and the inner race of the bearing 31 may contact and slide up and down the axle 21. The disadvantage of this arrangement, however, is that the inner race of the bearing 31 may rotate relative to the axle 21 during use. As a further alternative, the teeth 35 and the sprocket 22 may be omitted and rotation of the carriage 30 relative to the axle 21 may be prevented by other means. For example, the axle 21 may have a non-circular cross-section or the carriage 30 may have projections that engage with grooves in the axle 21. However, since the bearing 31 is circular, the use of a non-circular axle 21 is likely to increase the outer diameter of the bearing assembly 7. Furthermore, the inside of the axle 21 may be used to carry an airflow to the drive assembly 7, e.g. in order to cool or drive components of the drive assembly 7. Employing an axle 21 having a non-circular cross-section or grooves is likely to reduce the cross-sectional area inside the axle and thus impede the flow of air to the drive assembly 7.

The invention claimed is:

1. A cleaner head comprising:

a main body having an agitator chamber;

an axle that extends into the chamber;

a bearing assembly mounted on the axle, the bearing assembly configured to move along the axle in an axial direction between a first position and a second position and comprising a mount having a ramped surface;

a biasing member comprising a spring, the biasing member biasing the bearing assembly towards the first position; and an agitator that is configured to rotate relative to the axle, the agitator comprising a ramped surface at one end and mounted on the bearing assembly such that the ramped surface of the agitator mates with the ramped surface of the mount, the agitator pushing the bearing assembly against the biasing member towards the second position.

2. The cleaner head of claim 1, wherein the bearing assembly comprises a bearing secured to a carriage, and the carriage is prevented from rotating relative to the axle when the bearing assembly is in the second position.

3. The cleaner head of claim 2, wherein the cleaner head comprises an engagement that is engaged with the carriage when the bearing assembly is in the second position so as to prevent rotation of the carriage relative to the axle, and that is disengaged from the carriage when the bearing assembly is in the first position.

4. The cleaner head of claim 3, wherein the engagement of the cleaner head is a sprocket that surrounds the axle, and the carriage comprises teeth that are engaged with the sprocket when the bearing assembly is in the second position and that are disengaged from the sprocket when the bearing assembly is in the first position.

5. The cleaner head of claim 1, wherein the agitator is removable from the main body, and the biasing member biases the bearing assembly to the first position when the agitator is removed.

6. The cleaner head of claim 1, wherein the main body comprises an opening through which the agitator is removable, the cleaner head comprises an end cap attachable to the main body to close the opening, the agitator is mounted at a first end on the bearing assembly, and the agitator is mounted at a second end on a bearing or bushing seated within the end cap.

7. The cleaner head of claim 1, wherein the cleaner head comprises a drive assembly for driving the agitator, the drive assembly comprises a motor and is mounted on the axle, and the agitator surrounds the drive assembly.

8. The cleaner head of claim 7, wherein the bearing assembly contacts the drive assembly when in the first position.

9. The cleaner head of claim 7, wherein the cleaner head is attachable to a duct for rotation about an axis, and the drive assembly is mounted on the axle such that the centre of gravity of the cleaner head is located on a vertical plane containing the axis.

10. The cleaner head of claim 1, wherein the biasing member comprises a coil spring that surrounds the axle.

11. A cleaner head comprising:

a main body having an agitator chamber;

an agitator mounted within the agitator chamber;

a drive assembly comprising a motor for driving the agitator;

an axle that extends into the agitator chamber;

a bearing assembly mounted on the axle, the bearing assembly comprising a bearing and configured to move along the axle in an axial direction between a first position and a second position; and a biasing member comprising a spring, the biasing member biasing the bearing assembly towards the first position, wherein the drive assembly is mounted on the axle, the agitator surrounds the drive assembly and is mounted on the bearing assembly, and the agitator pushes the bearing assembly against the biasing member towards the second position, and wherein the agitator is coupled to the drive assembly when the bearing assembly is in the second position and uncoupled from the drive assembly when the bearing assembly is in the first position.

12. The cleaner head of claim 11, wherein the drive assembly comprises an electric motor.

13. The cleaner head of claim 11, wherein the cleaner head is attachable to a duct for rotation about an axis, and the drive assembly is mounted on the axle such that the centre of gravity of the cleaner head is located on a vertical plane containing the axis.

14. The cleaner head of claim 11, wherein the bearing assembly comprises a mount having a ramped surface, the agitator has a ramped surface at one end, and the agitator is mounted on the bearing assembly such that the ramped surface of the agitator mates with the ramped surface of the mount.

15. The cleaner head of claim 11, wherein the bearing assembly comprises a bearing secured to a carriage, and the carriage is prevented from rotating relative to the axle when the bearing assembly is in the second position.

16. A cleaner head comprising:

a main body having an agitator chamber;

an axle that extends into the chamber;

a bearing assembly mounted on the axle, the bearing assembly comprising a bearing and being moveable along the axle between a first position and a second position;

a biasing member comprising a spring, the biasing member biasing the bearing assembly towards the first position; and an agitator removably mounted within the chamber, wherein the main body comprises an opening through which the agitator is removable, the cleaner head comprises an end cap attachable to the main body to close the opening, and, when mounted within the chamber, the agitator is mounted at a first end on the bearing assembly, the agitator is mounted at a second end on a bearing or bushing seated within the end cap such that the agitator is laterally fixed with respect to the end cap when the end cap is attached to the main body, and the agitator pushes the bearing assembly against the biasing member towards the second position.

17. The cleaner head of claim 16, wherein the cleaner head comprises a drive assembly comprising a motor for driving the agitator, the drive assembly is mounted on the axle, and the agitator surrounds the drive assembly when mounted within the chamber.

18. The cleaner head of claim 16, wherein the bearing assembly comprises a mount having a ramped surface, the agitator has a ramped surface at one end, and the agitator is mounted on the bearing assembly such that the ramped surface of the agitator mates with the ramped surface of the mount.

19. The cleaner head of claim 16, wherein the bearing assembly comprises a bearing secured to a carriage, and the carriage is prevented from rotating relative to the axle when the bearing assembly is in the second position.

* * * * *